United States Patent [19]

DeLuccia

[11] Patent Number: 5,061,323

[45] Date of Patent: Oct. 29, 1991

[54] COMPOSITION AND METHOD FOR PRODUCING AN ALUMINUM ALLOY RESISTANT TO ENVIRONMENTALLY-ASSISTED CRACKING

[75] Inventor: John J. DeLuccia, Paoli, Pa.

[73] Assignee: The United States of America as represented by the Secretary of the Navy, Washington, D.C.

[21] Appl. No.: 599,557

[22] Filed: Oct. 15, 1990

[51] Int. Cl.[5] ..... C22F 1/04; B22F 3/02

[52] U.S. Cl. ..... 148/11.5 A; 75/249; 148/11.5 P; 148/437

[58] Field of Search ..... 75/249; 419/29, 42, 419/67, 68; 148/11.5 A, 11.5 P, 437

[56] References Cited

FOREIGN PATENT DOCUMENTS

0332430A1 9/1989 European Pat. Off. ..... 148/437

*Primary Examiner*—R. Dean

*Assistant Examiner*—Robert R. Koehler

*Attorney, Agent, or Firm*—James V. Tura; James B. Bechtel; Susan E. Verona

[57] ABSTRACT

A powder-derived aluminum alloy is provided which contains throughout its base aluminum alloy matrix a fine dispersion of elemental molybdenum particles. The articles formed from the alloy exhibit improved resistance to environmentally-assisted cracking, such as stress corrosion cracking and corrosion fatigue, at room and moderately elevated temperatures. An aluminum alloy powder of a composition usually used to produce high-strength aluminum alloys is blended with molybdenum powder to form a homogeneous powder blend containing up to about 1.0% by weight molybdenum. The powder blend is consolidated, including compacting it and extruding or otherwise hot working it to a total reduction ratio of at least 16 to 1. The hot-worked product is then heat treated in a conventional manner to maximize other desirable properties, such as strength.

24 Claims, No Drawings

COMPOSITION AND METHOD FOR PRODUCING AN ALUMINUM ALLOY RESISTANT TO ENVIRONMENTALLY-ASSISTED CRACKING

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

The present invention relates generally to aluminum alloys and more particularly to high-strength, molybdenum-containing, powder-derived aluminum alloys which have improved resistance to environmentally-assisted cracking at room or moderately elevated temperatures.

High-strength aluminum alloys, such as those in the 7000 series (Aluminum Association designation), are used extensively for structural aircraft components because of their combined lightness of weight and high strength. Generally speaking, these high-strength aluminum alloys suffer from poor resistance to environmentally-assisted cracking. For instance, when under load and subjected to a corrosive environment such as the sea water environment, these alloys are susceptible to stress corrosion cracking. The corrosive elements attack the aluminum surface, causing it to develop pitted areas, which serve as a potential nucleus for cracks. Further corrosion occurs within these cracks, which, in conjunction with the load, causes them to propagate, possibly resulting in catastrophic failure. Similarly, corrosion fatigue, or failure of the metal from corrosion combined with cyclic stress, is a problem with these high-strength aluminum alloys.

Various approaches have been tried to improve the stress corrosion cracking response of these high-strength aluminum alloys. New heat treating methods, such as overaging, and retrogression and re-aging, have been tried, and although these methods are effective in improving the alloy's stress corrosion cracking response, the alloy's mechanical properties decline. Surface coatings containing molybdates have been applied to aluminum, which react with the aluminum's protective oxide film to inhibit the development of surface pits.. Once a surface pit does develop, however, the coating does little to retard the growth of cracks emanating therefrom.

Powder metallurgy and rapid solidification processing techniques have been used to produce aluminum alloys having superior properties to alloys produced by conventional ingot metallurgy. For instance, molybdenum has been added to aluminum using these techniques to give the aluminum high strength at high temperatures. When molybdenum-containing aluminum is exposed to high temperature, molybdenum compounds such as molybdenum aluminide form, providing the added strength. Similarly, when molybdenum is added to aluminum as a melt ("prealloying"), molybdenum aluminide is formed upon solidification. No improvement in stress corrosion cracking resistance is observed in these high-temperature aluminum alloys over aluminum alloys not containing molybdenum.

SUMMARY OF THE INVENTION

It is therefore an object of the invention to provide a high-strength aluminum alloy which has good resistance to environmentally-assisted cracking.

It is a more particular object to provide such an alloy which has better resistance to stress corrosion cracking and corrosion fatigue at room and moderately elevated temperatures than currently-used high-strength aluminum alloys.

Another object of the invention is to provide a method of producing an aluminum alloy which has both high strength and good resistance to environmentally-assisted cracking.

Yet another object is to provide a method of improving the stress corrosion cracking response of high-strength aluminum alloys at ambient aircraft temperatures.

Briefly, these and other objects are accomplished by an aluminum alloy containing throughout its base aluminum alloy matrix a fine dispersion of elemental molybdenum particles. Articles formed from the alloy exhibit improved resistance to environmentally-assisted cracking, such as stress corrosion cracking and corrosion fatigue, at room and moderately elevated temperatures. Additionally, an increase in the inherent fracture toughness of the alloy is realized. A base aluminum alloy powder of a composition usually used to produce high-strength aluminum alloys is blended with molybdenum powder to form a homogeneous powder blend containing up to about 1.0% by weight molybdenum. The powder blend is consolidated, including compacting it and extruding or otherwise hot working it at a total reduction ratio of at least 16 to 1. The hot-worked product is heat-treated in a conventional manner to maximize other desirable properties such as strength.

Other objects, advantages and novel features of the invention will become apparent from the following detailed description thereof.

DESCRIPTION OF THE PREFERRED EMBODIMENT

A high-strength, powder-derived aluminum alloy is provided with improved resistance to environmentally-assisted cracking, such as stress corrosion cracking and corrosion fatigue, at room and moderately elevated temperatures by adding a dispersion of elemental molybdenum particles throughout the aluminum alloy matrix. The elemental molybdenum particles exposed at the surface of the alloy oxidize to form a passive film of $MoO_4$ which reinforces the $Al_2O_3$ on the alloy's surface, protecting the surface against corrosion.

A base aluminum alloy of the desired composition is reduced to powder using known powder metallurgy techniques. Any aluminum alloy may be used, but the invention is particularly useful with high-strength aluminum alloys such as those in the 2000, 6000, and 7000 series, since these alloys are particularly susceptible to environmentally-assisted cracking. The powder may be formed by rapidly solidifying a melt of the base aluminum alloy of choice. Rapid solidification is a convenient means of producing a powder and has the added advantage of producing particles which are homogeneous in composition. The powder product of rapid solidification may be further pulverized to reduce particle size, if desired. Other standard powder metallurgical techniques may, of course, be performed on the powder as desired, such as vacuum drying it to remove moisture.

A powder of essentially pure molybdenum is also provided using known powder metallurgy techniques The particle size of the powder is preferably such that it passes through a 325 mesh screen (ASTM std B214-76) (<45 microns). Finer particle size promotes better dispersion of the molybdenum particles throughout the base aluminum alloy particles providing greater strength to the aluminum. For this reason, the base aluminum alloy powder preferably has a similarly fine particle size.

The base aluminum alloy and molybdenum powders are then intimately mixed or blended in such proportions as to produce a homogeneous powder blend containing up to 1.0 weight percent molybdenum. Excessive molybdenum degrades room temperature mechanical properties such as strength and ductility. The powder blend may be vacuum dried either during or after blending to remove gases.

The powder blend is then consolidated by first compacting it into a 100% dense billet and then hot working it. The compaction may be achieved by first cold-isostatically compacting the powder blend into a 75% dense compact to enhance the ease of handling the powder, and then hot-isostatically pressing it to full density. After the cold isostatic pressing, the 75% dense compact may be encapsulated in an aluminum alloy container with an evacuation tube on one end thereof for degassing the compact prior to hot pressing it. After the degassing step the evacuation tube is crimped and sealed and the hot pressing step is performed, after which the hot compact is scalped of the container As an alternative to the cold isostatic pressing step, the powder blend may be sintered to achieve the necessary cohesion.

The 100% dense compact is then hot worked, such as by extrusion, at a reduction ratio of at least 16 to 1, preferably 20 to 1 or greater. The high extrusion ratio is necessary to reduce surface oxides, allowing better metallurgical bonding amongst the particles. The resulting hot-worked piece is then heat treated to impart to the alloy other desirable properties. For instance, if a 2000, 6000, or 7000 series (Aluminum Association designation) alloy was chosen for its high-strength potential upon heat treatment, the heat treatment would be one that would enhance strength, such as T6 treatment (Aluminum Association designation). The alloy may be further processed into useful articles.

In operation, the elemental molybdenum particles on the surface of the alloy form $MoO_4$ when exposed to an aqueous oxidizing environment such as sea water. The $MoO_4$ particles form a passive film that bonds with and reinforces the indigenous aluminum oxide film, preventing the underlying aluminum alloy from reacting with the environment. Other molybdates and molybdenum intermetallics will not form $MoO_4$ at the surface and do not themselves have this passivating effect.

The invention may best be illustrated by the following example in which an aluminum alloy was made according to the present invention.

EXAMPLE

A 150 pound charge of as-atomized 7075 aluminum alloy powder having the chemical composition and size distribution shown in TABLE I was vacuum dried at 250 degrees F.

TABLE I

CHEMICAL COMPOSITION AND SIZE DISTRIBUTION OF AS-ATOMIZED 7075 POWDER

| Chemical Composition (wt. %) | | | | | | | | |
|---|---|---|---|---|---|---|---|---|
| Cu | Mg | Cr | Zn | Si | Fe | Be | Co | Al |
| 1.5 | 2.49 | 0.25 | 5.55 | 0.04 | 0.05 | 0.001 | 0.03 | Bal |

| Size Distribution | | |
|---|---|---|
| Screen size* | | Weight % |
| −100 + 200 | | 2.0 |
| −200 + 325 | (45–75 microns) | 9.2 |
| −325 | (<45 microns) | 88.8 |

*ASTM std. B214–76

To this charge was added a high-purity molybdenum powder of 100% −325 mesh size (ASTM std. B214-76) (<45 microns) in an amount such that the combination powder thus formed was 0.62 weight percent molybdenum. This combination powder charge was then vacuum dried and blended at 250 degrees F before being compacted into a 100% dense billet. Compaction was achieved in stages. First, the powder blend was cold-isostatically compacted at 193 MPa (28 ksi) into a 75% dense compact. Then, the compact was encapsulated in an aluminum alloy container or can with an evacuation tube on one end thereof. The encapsulated (or "canned") compact was then degassed in two steps—by first heating it to 500 degrees F under vacuum and soaking it at that temperature for one hour, and then increasing the temperature to 890 degrees F for another one hour soak. The evacuation tube was then sealed off and the compact was hot pressed to full density at that temperature. The compact was then scalped to remove the canning material and extruded at 750 degrees F at a reduction ratio of 22.4 to 1. Samples were then blanked out to test-sample size and then heat treated to the T6 temper. For 7075 alloys this treatment is: a) solution treating alloy at 880 degrees F (470 degrees C.) for 1 hour; b) water quenching alloy; and c) aging alloy for 24 hours at 250 degrees F (121 degrees C.). The blanks were then final-machined for testing.

The samples made according to the above example were tested for various properties. All testing was performed in accordance with existing ASTM Standards or Recommended Practices. The test results were compared to results of the same tests performed on comparison samples. The comparison samples were made from the same charge of the base aluminum alloy powder and were processed in the same manner as the sample alloys of the invention except that no molybdenum was included in the alloy.

The directions of each sample blanked were noted as to their orientation with respect to the hot working direction. The direction of the sample parallel to the hot-working direction is referred to as the longitudinal direction, the direction perpendicular to that direction but parallel to the direction of greatest reduction is referred to as the short transverse direction, and the direction perpendicular to both of these directions is referred to as the transverse direction. Surfaces of or planes within the samples are referred to by the two directions which define them.

The fracture toughness values for both the sample according to the invention and the comparison sample were determined using the standard test method E 399-83. The samples were loaded in the short transverse direction and cracked in the longitudinal direction. The specimens were precracked using a 0.1 ratio of minimum-to-maximum load to a normalized crack length, a/W (crack length/specimen longitudinal width), of approximately 0.55 inch. A preload of 00 lbs. and a loading rate of 4500 lbs./min. were utilized for the test. After failure the actual crack length was calculated based on the average of five points across the precrack front. The value of KQ was determined by the 5% offset method. The results of these tests are shown in Table II.

TABLE II

| FRACTURE TOUGHNESS, KQ | |
|---|---|
| 7075 T6 + 0.62 wt. % Mo | 7075 T6 |
| 52.0 ksi sq. rt. in. | 48.5 ksi sq. rt. in. |

Note: average of 3 specimens

The stress corrosion cracking thresholds of the sample and comparison alloys were determined utilizing double cantilever beam specimens and the ASTM recommended test procedure. These thresholds represent the minimum load points at which no stress corrosion cracking occurs in each sample. One percent NaCl solutions pH's of 2 and 6 were used for the tests. These solutions were added daily, except for weekends, for the entire period of the test. The precracks were produced by mechanical overloads. The specimen was oriented along the longitudinal-short transverse plane since this orientation is the most susceptible to stress corrosion cracking. The starting stress intensity was approximately 30 ksi for all specimens. The thresholds are shown in Table III.

TABLE III

| STRESS CORROSION CRACKING THRESHOLD, KIscc | | |
|---|---|---|
| | 7075 T6 + 0.62 wt. % Mo. | 7075 T6 |
| 1% NaCl 6 pH | 21.2 ksi sq. rt. in. | 18.8 ksi sq. rt. in. |
| 1% NaCl 2 pH | 21.8 ksi sq. rt. in. | 17.5 ksi sq. rt. in. |

Note: average of three specimens

The stress corrosion cracking initiation properties of the samples were examined using the ASTM standard method for Alternate Immersion, G44-75. The test environment was a 10 minute immersion in 3.5% NaCl and a 50 minute drying in 45% relative humidity. Table IV shows the times to failure for four samples of the invention alloy, four samples of the 7075 T6 powder comparison alloy, and two samples of a 7075 T6 wrought alloy at applied stresses of 25% and 50% of the short transverse yield strength (19 and 38 ksi, respectively). Run-out time was 34 days. The specimens were checked daily for cracking using a 15× microscope.

TABLE IV

| ALTERNATE IMMERSION STRESS CORROSION CRACKING Time to Failure | | |
|---|---|---|
| | Applied Stress | |
| | 19.0 ksi | 38.0 ksi |
| 7075 T6 + 0.62 wt. % Mo | 4 run-outs | 4 run-outs |
| 7075 T6 w/o Mo | 4 run-outs | 1-32 days<br>3 run-outs |
| 7075 T651 wrought | 1-1 day<br>1-2 days | 2-1 day |

Corrosion fatigue crack growth thresholds were determined for the alloy according to the invention and the comparison powder alloy as well as the wrought 7075 T6. The tests were conducted using the guidelines set forth by the ASTM Standard test method E-647. The two testing atmospheres were dry nitrogen and 1% NaCl at 6 pH. The specimens were tested in the short transverse orientation, the direction most sensitive to corrosion fatigue. During the tests, load shedding was conducted to obtain a constantly decreasing stress intensity range (SIR). The corrosion fatigue threshold is the SIR point at which no more cracking occurs. Results of the corrosion fatigue tests are summarized in TABLE V.

TABLE V

| Corrosion Fatigue Threshold, delta $K_{th}$ (Ksi sq. rt. in.) | | | |
|---|---|---|---|
| Atmoshere | 7075 T6 + Mo | 7075 T6 P/M | 7075 wrought |
| Dry $N_2$ | 5.3 | 4.0 | 3.0 |
| 1% NaCl | 4.5 | 3.2 | >1.0 |

Some of the many features and advantages of the invention should now be readily apparent. For example, a high-strength aluminum alloy has been provided which has better resistance to environmentally-assisted cracking at ambient aircraft temperatures than conventional high-strength aluminum alloys. More particularly, such an alloy and a method of making it has been provided which has better resistance to stress corrosion cracking and corrosion fatigue, and higher fracture toughness than currently-used high-strength aluminum alloys, as the test results indicate. Such an alloy is particularly suited for structural aircraft components.

Other embodiments and modifications of the present invention may readily come to those of ordinary skill in the art having the benefit of the teachings of the foregoing description. For example, the invention may be practiced using other base aluminum alloys than those specifically described. Variations in the processes for producing the powders, hot working the compact, and heat treating the hot-worked billet are contemplated. Therefore, it is to be understood that the present invention is not to be limited to the teachings presented and that such further embodiments and modifications are intended to be included in the scope of the appended claims.

What is claimed is:

1. A method of producing an aluminum alloy having improved resistance to environmentally-assisted cracking at room and moderately elevated temperatures, comprising the steps of:

providing a base aluminum alloy powder;

providing a molybdenum powder;

blending the base aluminum alloy and molybdenum powders to form a homogeneous powder blend which contains up to 1.0% by weight molybdenum; and consolidating the powder blend into a billet.

2. The method of claim 1, wherein the base aluminum alloy is selected from the group consisting of 2000, 6000, and 7000 series aluminum alloys.

3. The method of claim 2, wherein the base aluminum alloy is a 7075 aluminum alloy.

4. The method of claim 1, wherein the powder blend contains 0.62% by weight molybdenum.

5. The method of claim 1, wherein said consolidating step comprises the steps of compacting the powder blend and hot working the compacted powder blend.

6. The method of claim 5, wherein said hot-working step comprises the step of extruding.

7. The method of claim 6, wherein said extruding step is performed at about 750 degrees F.

8. The method of claim 6, wherein said extruding step is performed at a reduction ratio of at least 16 to 1.

9. The method of claim 6, wherein said extruding step is performed at a reduction ratio of at least 20 to 1.

10. The method of claim 5, wherein said compacting step comprises the step of hot compacting the powder blend to 100% density.

11. The method of claim 10, wherein said compacting step further comprises the step of cold compacting the powder blend into a 75% dense compact prior to said hot-compacting step.

12. The method of claim 10 wherein said compacting step further comprises the step of sintering the powder blend prior to said hot-compacting step.

13. The method of claim 10, wherein said compacting step further comprises the step of degassing prior to said hot-compacting step.

14. The method of claim 1, wherein the particles of the molybdenum powder are less than 45 microns.

15. The method of claim 1, wherein most of the particles of the aluminum powder are less than 45 microns.

16. The method of claim 1, wherein said step of providing a base aluminum alloy powder comprises rapidly solidifying a molten aluminum alloy of the desired composition.

17. The method of claim 1, further comprising the step of vacuum drying the powder blend prior to said consolidating step.

18. The method of claim 1, further comprising the step of heat treating the consolidated billet.

19. The method of claim 18, wherein said heat treating step is a high-strength heat-treating step.

20. A method of producing an aluminum alloy having improved resistance to environmentally-assisted cracking at room and moderately elevated temperatures, comprising the steps of:

providing a base aluminum alloy powder selected from the group consisting of 2000, 6000, and 7000 series aluminum alloys;

providing a molybdenum powder;

blending the base aluminum alloy and molybdenum powders to form a homogeneous powder blend which contains up to 1.0% by weight molybdenum;

cold compacting the powder blend to a 75% dense compact;

degassing the 75% dense compact;

hot compacting the 75% dense compact to a 100% dense billet;

extruding the 100% dense billet at a reduction ratio of at least 20 to 1; and heat treating the extruded billet to impart high strength thereto.

21. An aluminum alloy having improved resistance to environmentally-assisted cracking at room and moderately elevated temperatures, produced by consolidating a homogeneous blend of a base aluminum alloy powder and molybdenum powder.

22. The aluminum alloy of claim 21 wherein said molybdenum powder comprises up to 1.0% by weight of the aluminum alloy.

23. The aluminum alloy of claim 21 wherein said base aluminum alloy powder is selected from the group consisting of 2000, 6000, and 7000 series aluminum alloys.

24. The aluminum alloy of claim 21, further produced by heat treating to impart high strength thereto.

* * * * *